United States Patent [19]

Waltke

[11] Patent Number: 4,785,966

[45] Date of Patent: Nov. 22, 1988

[54] SLIDE GATE ASSEMBLY

[75] Inventor: David L. Waltke, Beatrice, Nebr.

[73] Assignee: Hoover Group, Inc., Roswell, Ga.

[21] Appl. No.: 117,281

[22] Filed: Nov. 5, 1987

[51] Int. Cl.[4] ..... B67D 5/60

[52] U.S. Cl. ..... 220/345; 220/1.5; 222/559; 222/561

[58] Field of Search ..... 220/345, 1.5; 222/559, 222/561

[56] References Cited

U.S. PATENT DOCUMENTS

| | | | |
|---|---|---|---|
| 2,293,160 | 8/1942 | Miller et al. | 220/1.5 X |
| 2,523,981 | 9/1950 | Wittliff, Jr. | 220/345 X |
| 2,750,074 | 6/1956 | Dorey | 222/561 X |
| 3,220,612 | 11/1965 | Thomson | 220/1.5 X |
| 3,344,958 | 10/1967 | Kaanehe | 222/559 |
| 4,475,672 | 10/1984 | Whitehead | 222/561 |
| 4,746,034 | 5/1988 | Ata et al. | 220/1.5 X |

*Primary Examiner*—Steven M. Pollard
*Attorney, Agent, or Firm*—Harness, Dickey & Pierce

[57] ABSTRACT

A slide gate assembly for closure of a discharge opening in a container for bulk material which includes a continuous flexible seal residing in an inverted U-shaped chamber around the perimeter of the discharge opening. This flexible seal has a generally rectangular cross-section with a protruding lip or flap extending inward and downward from the lower inside corner of the seal cross-section. In addition, the seal has compressible ribs in the bottom side for engagement with the upper side of the slide gate. The seal lip or flap provides a squeegee action on the upper side of the slide gate during insertion and removal of the slide gate which insures that the upper surface of the slide gate outside of the seal lip is free of material so that a positive seal between the discharge opening and the slide gate is effected when the upper surface of the slide gate is pressed against the protruding ribs on the bottom side of the seal.

6 Claims, 3 Drawing Sheets

SLIDE GATE ASSEMBLY

BACKGROUND AND SUMMARY OF THE INVENTION

The present invention relates to closures for containers and more particularly to a slide gate closure assembly for a bottom discharge bin for storing and transporting bulk material.

Various methods of closure of discharge openings from bulk material containers have been used in the prior art. Some containers utilizing a bottom discharge generally have a sliding gate valve type closure which, when open, allows the contents of the container to be discharged therethrough and when closed, shuts off the material flow. These gate closures are adequate. However, there is often a build-up of material fines on the upper surface of the slide gate which gets in the way of complete sealing of the opening when the slide gate is closed. These fines become packed and caught between the surface of the slide gate and the perimeter of the opening, gasket or seal that may surround the opening in conventional closure assemblies preventing complete re-sealing of the bottom discharge opening of the container.

Accordingly, various sealing or gasketing designs such as those disclosed in U.S. Pat. Nos. 3,524,567 and 3,704,722 and have been implemented. However, these gaskets, being positioned adjacent to the opening, require the use of fasteners or adhesives to fix the gasket in position. In addition, any gasket that protrudes into the path of material discharge is often pulled from its mounting by the material exiting from the bin.

It is an object of the present invention to provide an improved slide gate closure assembly which includes a gasket or seal that can be retained without fasteners or adhesives.

It is a further object of the present invention to provide a slide gate closure assembly which utilizes a portion of the seal to automatically clean off the top side of the slide gate as it is moved between the open and closed positions therefore keeping the material handled from coming between the slide gate and the sealing portion of the seal.

These and other objects, features, and advantages of the invention should be apparent to one of ordinary skill in the art upon a reading of the specification which follows and with reference to the accompanying drawings.

DETAILED DESCRIPTION OF THE PREFERRED EMBODIMENT

Figure 1:
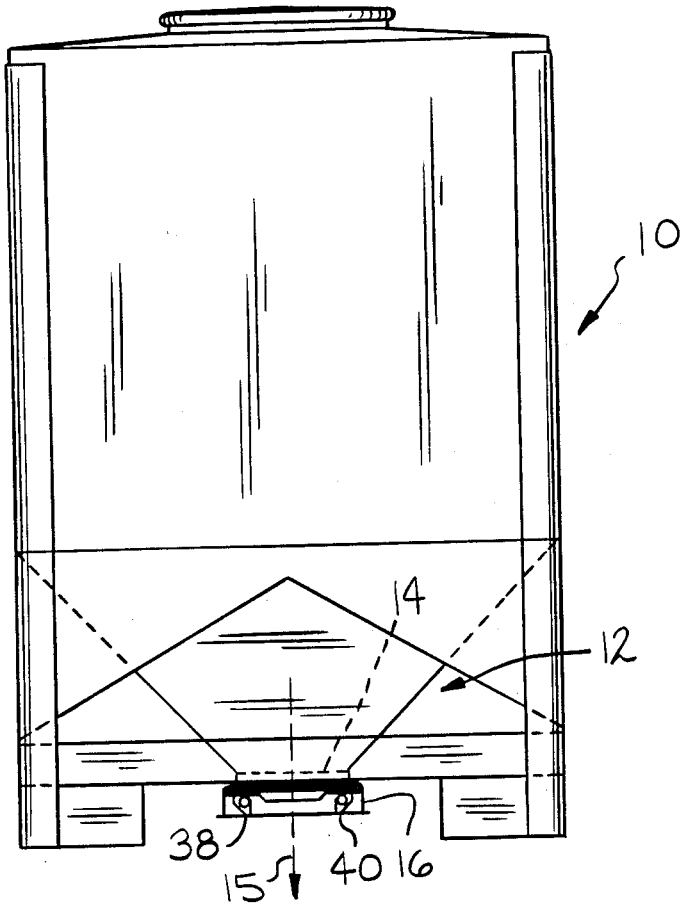
FIG. 1 is a front elevation view of a storage container including a bottom discharge opening and a slide gate closure assembly according to the present invention.
Figure 2:
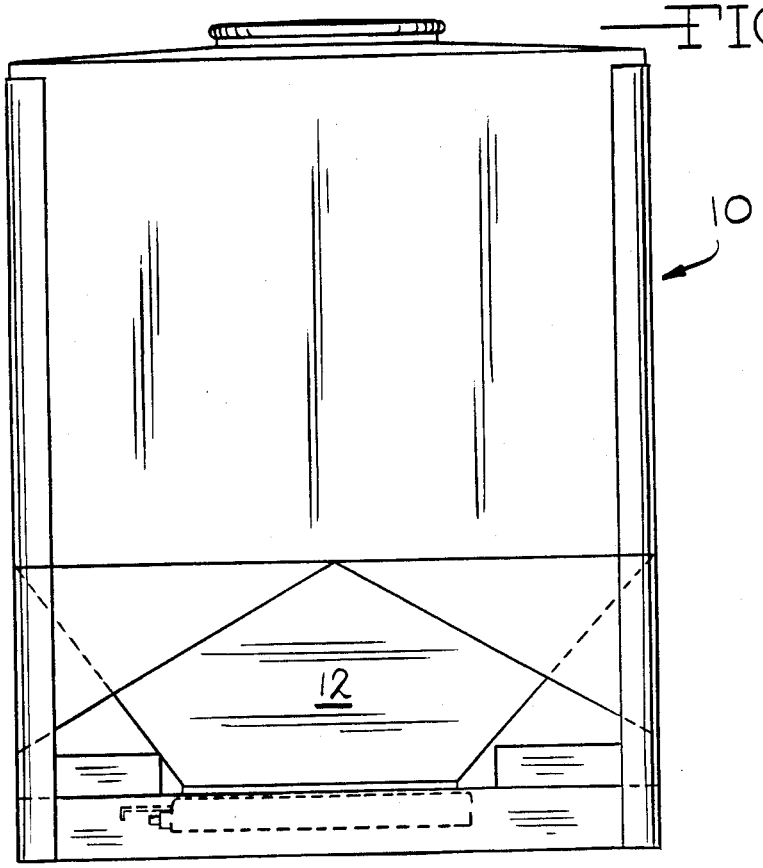
FIG. 2 is a side elevation view of the container shown in FIG. 1.
Figure 3:
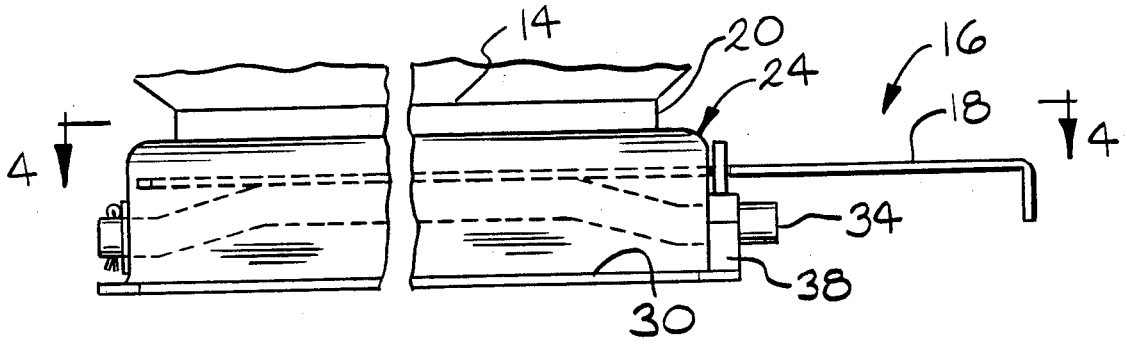
FIG. 3 is an enlarged view of the discharge opening and the slide gate assembly.

Referring to FIG. 1, a bulk material container or bin 10 is shown having a generally rectangular internal hopper 12 which terminates at its lower end in discharge opening 14. Slide gate assembly 16 according to the present invention is positioned below discharge opening 14.

Figure 5:
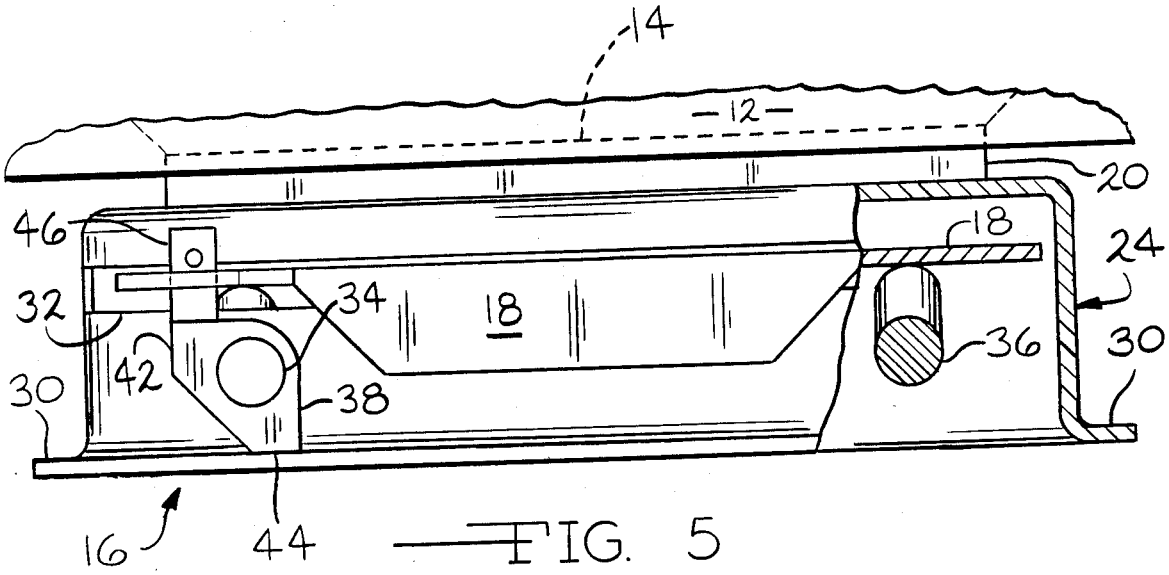
FIG. 5 is an enlarged fragmentary front view of the slide gate assembly shown in FIG. 1.
Figure 6:
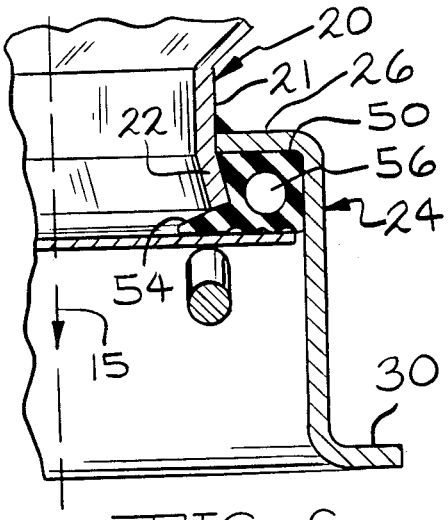
FIG. 6 is a fragmentary sectional view of a portion of the slide gate assembly showing the slide gate in the upper closed and engaged position.

Projecting downward from discharge opening 14 is discharge passage member 20, best shown in FIGS. 5 and 6, having a portion 21 parallel to the axis of discharge 15 through opening 14 and an outer lip portion 22 directed at an angle away from the axis of discharge 15 through opening 14.

Under the discharge passage member 20 is slide gate assembly 16 which includes support housing 24 having a Z-shaped cross section. The inwardly directed edge 26 of support housing 24 is attached to discharge passage member portion 21. The middle portion of the slide gate support housing 24 is directed generally parallel to the axis of discharge through opening 14. The outwardly projecting edge 30 of support housing 24 is directed normal to the axis of discharge.

The middle portion of support housing 24 includes a rectangular aperture or slot 32 through which slide gate 18 slides. Slot 32 is generally positioned in the plane of the discharge end of discharge passage member 20. The width, or longer dimension of slot 32 is slightly wider than slide gate 18. The height of slot 32 is sufficient to allow vertical movement of slidegate 18 in response to the cam bar motion as described below.

Figure 7:
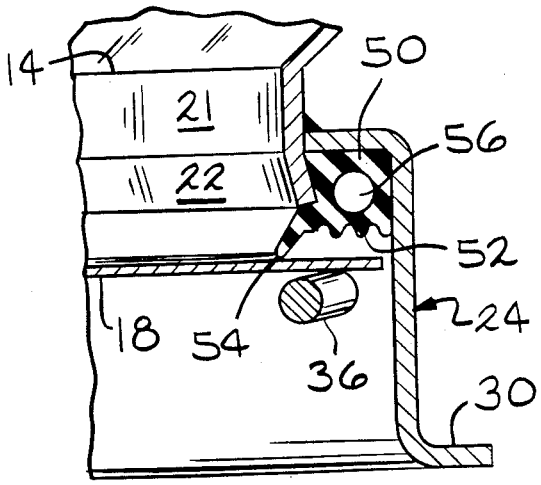
FIG. 7 is a sectional view similar to that shown in FIG. 6 with the slide gate in the lower closed and disengaged position.

A pair of elongated cam bars 34 and 36 are pivotally mounted in the middle portion of slide gate support housing 24 beneath slot 32 and extend lengthwise under slide gate 18 in the direction of slide gate motion. Cam bars 34 and 36 may be rotated between an engaged position with the slide gate 18 and a disengaged position as shown in FIGS. 6 and 7 respectively. With cam bars 34 and 36 in the disengaged position, slide gate 18 may be withdrawn from the opening allowing discharge of the contents of container 10 through opening 14. Movement of cam bars 34 and 36 from the disengaged position to the engaged position raises slide gate 18 into firm engagement with seal 50 as shown in FIG. 6.

Movement of cam bars 34 and 36 between the engaged and disengaged positions shown in FIGS. 6 and 7 is facilitated by cam stops 38 and 40 each fixed to one end of cam bars 34 and 36 respectively. Flat portion 44 of cam stop 38, as shown in FIG. 5, engages the outwardly projecting surface 30 of support housing 24 when cam bar 34 is in the engaged position shown in FIGS. 5 and 6. Portion 42 of cam stop 38 engages edge 30 of support housing 24 when cam bar 34 is in the disengaged position similar to that shown in FIG. 7 for cam bar 36. When cam bars 34 and 36 are in the engaged position, locking tabs 46 on each cam stop engage corresponding notches 48 in slide gate 18 preventing withdrawal of the slide gate 18 when it is in the closed, engaged position.

As shown in FIGS. 6 and 7, the unique seal 50 according to the present invention is disposed in an inverted U-shaped chamber formed between support housing 24 and discharge passage member 20. Seal 50 is made of a flexible and compressible material such as 40–60 Duro EPDM rubber. The seal 50 is of generally rectangular cross section in the preferred embodiment as shown in FIGS. 6 and 7 and includes a centrally disposed bore 56 which enhances the flexibility and compressibility of the seal body. Seal 50 is continuous and resides in the U-shaped channel surrounding the end of discharge passage member 20. Lip portion 22 of discharge passage member 20 projects outwardly, wedging seal 50 within the chamber thus retaining seal 50 in place without the use of adhesives or other fastening devices. In cross section, seal 50 includes a protruding continuous yieldable lip or flap 54 which projects downward at an angle toward the axis of discharge from the lower inward corner of seal 50. Along the bottom side of seal 50 are yieldable ribs 52. Ribs 52 are positioned so that they run parallel to the perimeter of the discharge passage member 20 along the bottom side of seal 50.

Figure 4:
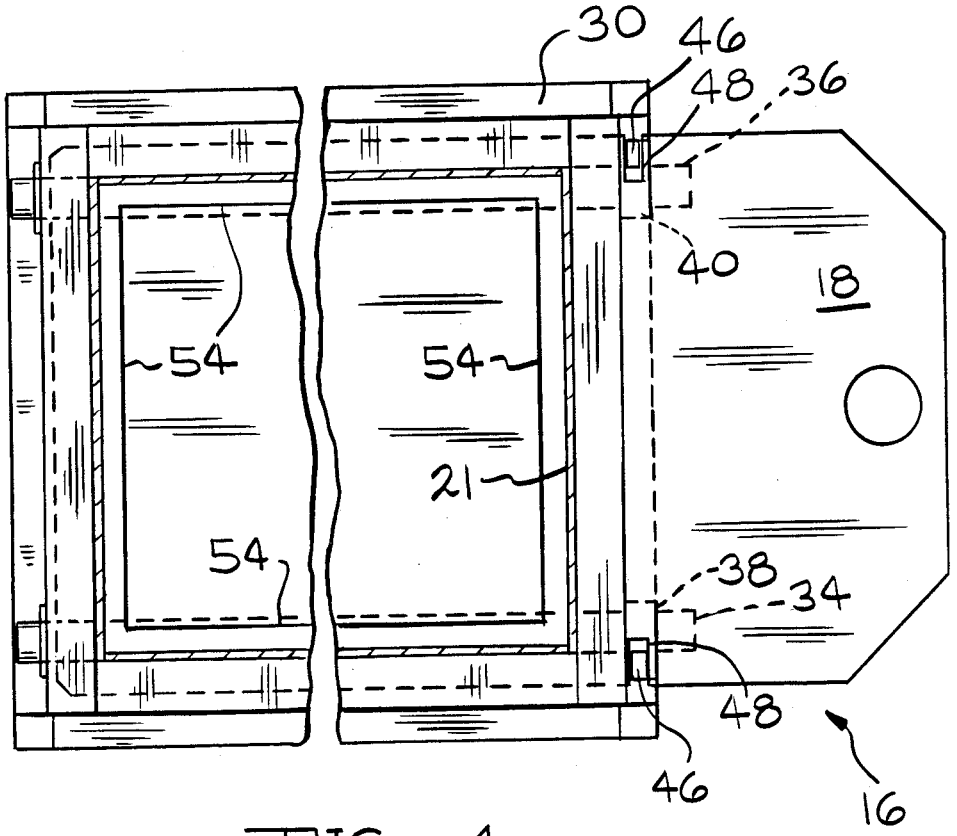
FIG. 4 is a top view of the slide gate assembly taken along the line 4—4 shown in FIG. 3.

In operation, starting from the slide gate assembly being in the closed position as shown in FIG. 5, a slide gate operating cycle begins with the bin fully loaded. The slide gate is initially in the closed and engaged position with cam bars 34 and 36 pressing slide gate 18 against seal 50 as shown in FIG. 6 and locking tabs 46 engaged with corresponding notches 48 in the sides of slide gate 18 as shown in FIGS. 4 and 5.

Cam bars 34 and 36 are then rotated to the disengaged position allowing slide gate 18 to move vertically downward, disengaging the upper side of slide gate 18 from ribs 52 of seal 50. This downward motion minimizes the compressive loading of the slide gate against seal 50. Moving cam bars 34 and 36 to the disengaged position also rotates locking tabs 46 out of engagement with the corresponding notches 48 in slide gate 18. In the lower closed position material discharge from bin 10 is still prevented because projecting lip 54 of seal 50 is still engaged with the upper side of slide gate 18 as shown in FIG. 7.

With cam bars 34 and 36 in the disengaged position, slide gate 18 is withdrawn allowing bulk material discharge downward through the discharge member 20. As slide gate 18 is withdrawn, bulk material is swept from the upper surface of slide gate 18 by seal lip 54 which remains in contact with slide gate 18.

When the bin is emptied of its contents or it is desired to stop material discharge, slide gate 18 is inserted through slot 32 to the closed position under discharge passage member 20. As slide gate 18 is inserted, seal lip 54 wipes the upper surface of the slide gate clear of material thus ensuring that a clean, debris free surface is presented to ribs 52 when slide gate 18 is closed and cam bars 34 and 36 rotated to the closed and engaged position to effect a positive closure seal.

As can be seen from FIG. 7, when slide gate 18 is removed, flow of material through the discharge opening can not dislodge seal 50 from its retaining chamber. Thus seal 50 may be securely installed without the use of fasteners or adhesive.

From the above description, it is seen that this invention provides an improved slide gate assembly for use on bulk material containers providing improved sealing capability. Although a rectangular opening and corresponding slide gate assembly is shown and described in the preferred embodiment above, the present invention can be applied to openings of other shapes such as circular or oval openings. Accordingly, the detailed description above is for one preferred embodiment. Modification in the above described structure can, of course, be made within the scope and spirit of the invention and the description above is illustrative only and not intended to limit the scope of the appended claims.

What is claimed is:

1. In a container for bulk material having a bottom discharge terminating in a downwardly extending discharge passage member, a closure assembly for said discharge passage member comprising:

a slide gate slidably supported at a position below said discharge passage member;

seal means between said discharge passage member and said slide gate having an inwardly and downwardly protruding lip yieldably engageable with said slide gate to form a fluid tight passage between said container and said slide gate when said slide gate is in a first upper closed position engaged with said seal means and second slide position located below said first position;

means for movably supporting said slide gate for movement of said slide gate between said first and second positions and a third open position to one side of said discharge passage member allowing material discharge therethrough; and actuating means engageable with said slide gate for urging said slide gate into firm engagement against said seal means when said slide gate is in said first position.

2. A closure assembly according to claim 1 wherein said means for movably supporting said slide gate includes:

a slide gate support housing extending downwardly from said discharge passage member and having an elongated aperture through which said slide gate is slideably disposed, said housing cooperating with said discharge passage member to form an inverted generally U-shaped retention chamber for said seal means, said chamber having a base portion and downwardly extending legs, said seal means being positioned in said chamber, and one of said legs being deflected toward the other of said legs so as to clamp said seal means therebetween.

3. A closure assembly according to claim 2 wherein said actuating means comprises:

an elongated cam bar movably supported by said housing, said bar being rotatable between a position engaging the underside of said slidegate pressing said slidegate against said discharge passage member and a position disengaging said slidegate from said discharge passage member allowing said slidegate to be withdrawn to said third position; and a cam stop attached to said cam bar, said cam stop having two eccentric lobes engageable with said housing to limit the rotation of said cam bar between said engaged position and said disengaged position.

4. A closure assembly according to claim 2 wherein said seal means comprises:

a continuous closed flexible seal body;

said seal body having a generally rectangular cross section having an upper side, an inner side, an outer side, and a lower side;

a yieldable portion of said seal body forming a projecting lip extending toward the interior of said discharge passage member from the intersection of said inner side and said lower side of said rectangular cross section to form a fluid tight passage when said slidegate is in said first or second position; and yieldable ribs on said lower side of said seal body engagable with said slidegate when said slidegate is in said first position;

said seal body being positioned in said retention chamber between said housing and said discharge passage member so that said lip extends inward and downward toward the direction of discharge from said container.

5. The closure assembly according to claim 4 wherein said seal lip is continuously in contact with said slidegate when said slidegate is moved between said second and third positions thus wiping said slidegate clear of accumulated material.

6. In a material container for bulk material having a container body, a bottom discharge passage member having an open end for material discharge therethrough along an axis of discharge and a closure assembly for said discharge passage member, said closure assembly comprising:

a slidegate shaped to underlay and close off said discharge passage member, said slide gate having an upper side and an under side;

a slidegate support housing surrounding said discharge passage member having a cross section having an inwardly directed portion, a middle portion generally parallel to the axis of discharge, and an outwardly directed portion, the edge of said inwardly directed portion abutting said discharge passage member forming a continuous inverted U-shaped chamber between said discharge passage member and said housing;

said inverted U-shaped chamber having an upper base portion and two downwardly extending legs, one of said legs being deflected inward toward the other of said legs;

said housing having an elongated aperture in said middle portion, said aperture having a longitudinal axis and a transverse axis, said longitudinal axis lying in the plane of said end of said discharge passage member and said transverse axis parallel to said axis of discharge, through which said slidegate is slideably disposed;

a plurality of elongated cam bars movably supported by said housing, said bars being rotatable between a position engaging the underside surface of said slidegate pressing said slidegate against said discharge passage member and a position disengaging said slidegate from said discharge passage member allowing said slidegate to be withdrawn from said open end;

a plurality of cam stops attached to said cam bars, said cam stops having two eccentric lobes to limit rotation of said cam bars between said engaged position and said disengaged position;

a continuous closed flexible seal body retained in said chamber surrounding said discharge passage member, said body having a generally rectangular cross section having an upper side, an inner side, an outer side and a lower side; and a yieldable portion of said body forming a projecting lip extending downward and toward the interior of said discharge passage member from the intersection of said inner side and said lower side of said rectangular cross section, said body having yieldable ribs in said lower side engagable with said slide gate when said cam bars are in said engaged position.

* * * * *